United States Patent [19]

Henc

[11] 3,994,489

[45] Nov. 30, 1976

[54] ROLLING VACUUM FEED TABLE

[76] Inventor: Edward V. Henc, R.D. 2, Malvern, Pa. 19355

[22] Filed: Sept. 19, 1974

[21] Appl. No.: 507,494

[52] U.S. Cl. ..... 271/132; 271/14; 271/144; 271/171

[51] Int. Cl.[2] ..... B65H 3/12

[58] Field of Search ..... 271/99, 102, 112, 132, 271/134, 137, 138, 144, 161, 165, 166, 131, 171, 14, 15, 90; 226/95

[56] References Cited

UNITED STATES PATENTS

| | | | |
|---|---|---|---|
| 2,828,126 | 3/1958 | Labombarde | 271/132 |
| 3,391,926 | 7/1968 | Jaatinen | 271/112 |
| 3,486,749 | 12/1969 | Billings | 271/112 |
| 3,525,518 | 8/1970 | Oaten | 271/165 |
| 3,549,004 | 12/1970 | Zusman | 226/95 |
| 3,570,845 | 3/1971 | Kellerman | 271/131 |
| 3,588,095 | 6/1971 | Ward, Jr. | 271/132 |
| 3,661,381 | 5/1972 | Kuzniak | 271/90 |
| 3,677,537 | 7/1972 | Hawthorne | 271/112 |
| 3,709,483 | 1/1973 | Henc | 271/132 |

FOREIGN PATENTS OR APPLICATIONS

| | | | |
|---|---|---|---|
| 799,339 | 11/1968 | Canada | 271/132 |

*Primary Examiner*—Robert W. Saifer
*Attorney, Agent, or Firm*—Steele & Petock

[57] ABSTRACT

A method of, and apparatus for, feeding corrugated blanks from a stack in which the lowermost blank is advanced to processing machinery on a feed bed which comprises rollers mounted above a vacuum source in such manner as to enable the advancing blank to be held flat while minimizing friction between the advancing blank and the feed bed. In one preferred embodiment, a kicker feed bar is utilized which is depressed with respect to the rollers to enable the lowermost blank to be advanced while maintaining substantially the same vertical height in a flat plane until reaching the proximity of the processing machinery.

23 Claims, 13 Drawing Figures

FIG. 1
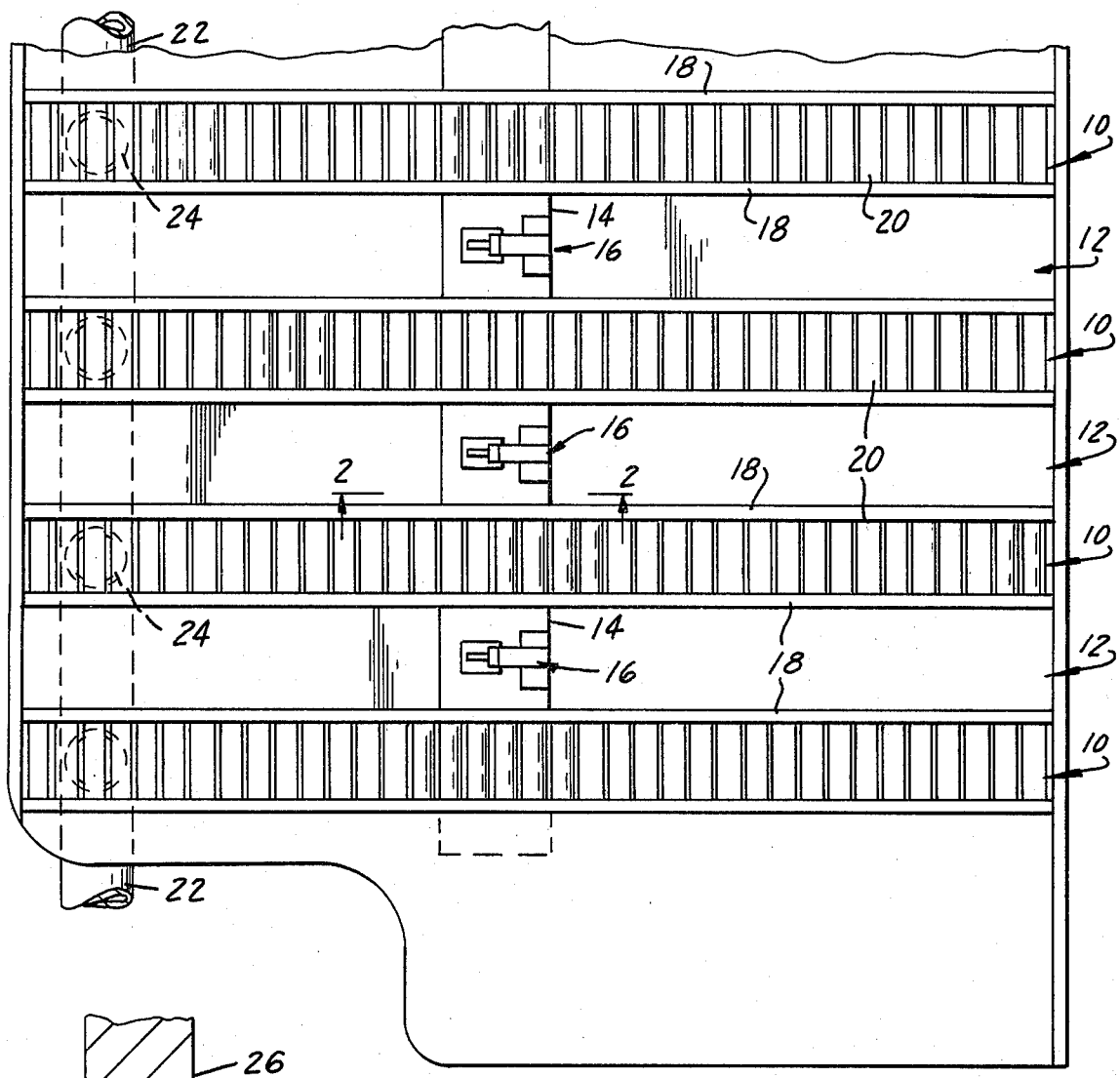
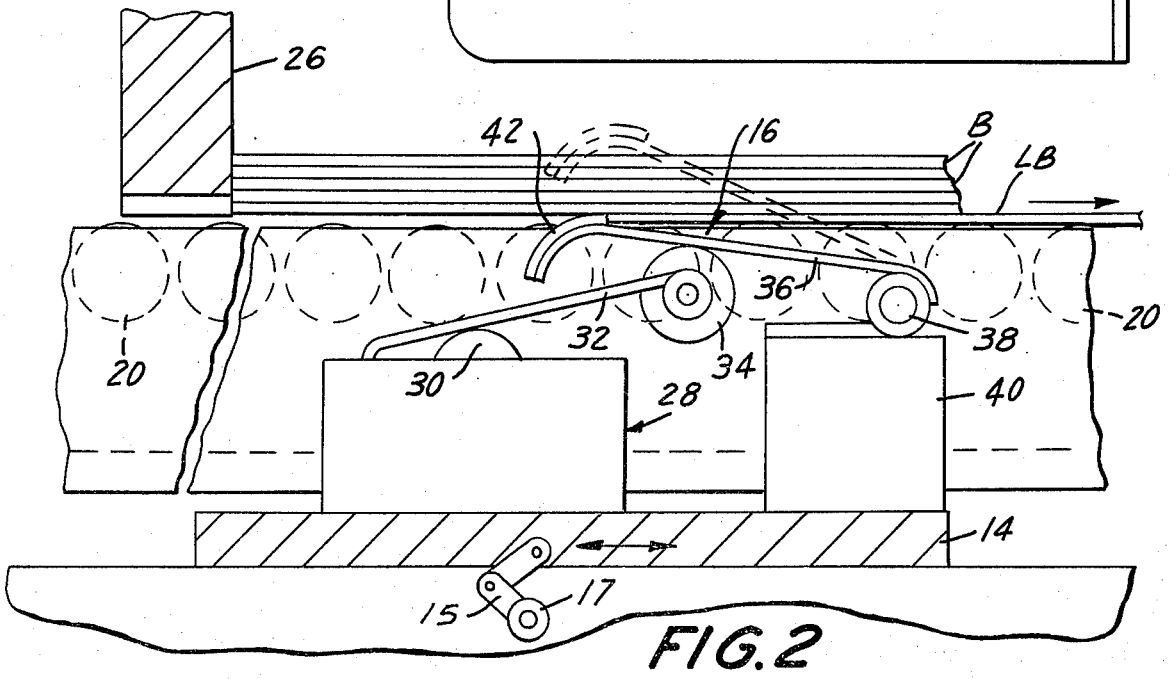
FIG. 2

FIG. 3
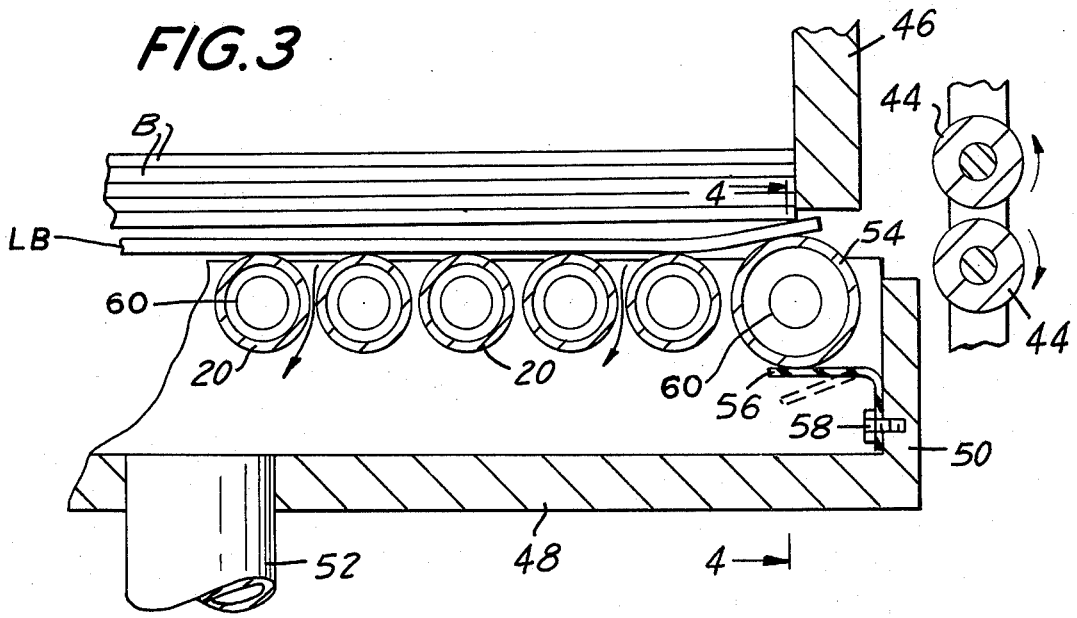
FIG. 4
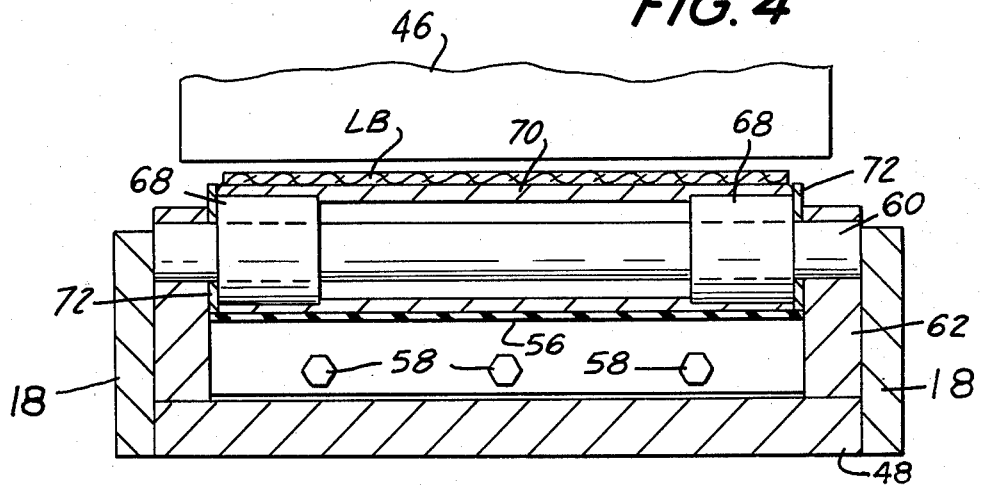
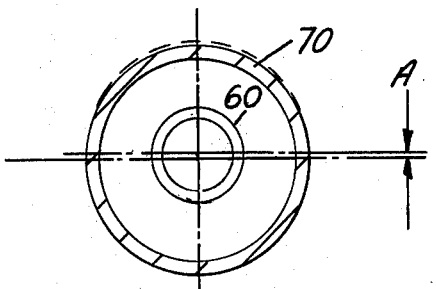
FIG. 5
FIG. 3A
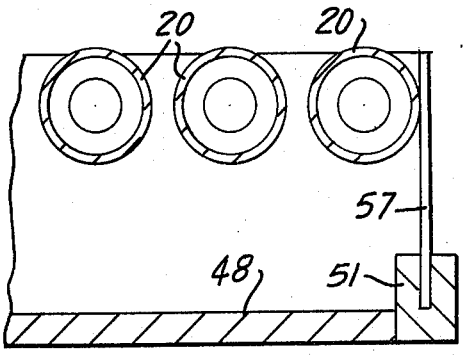

FIG. 8
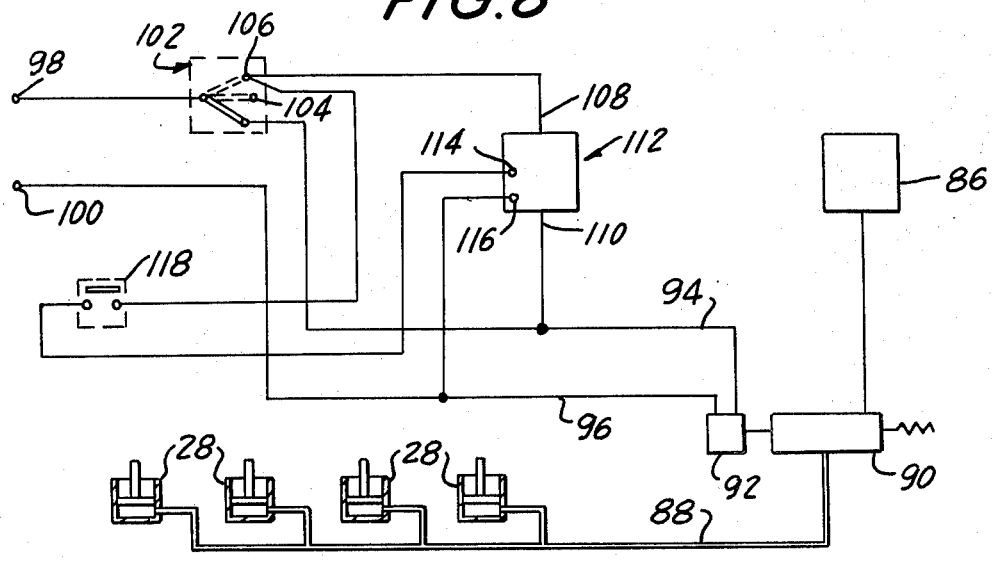
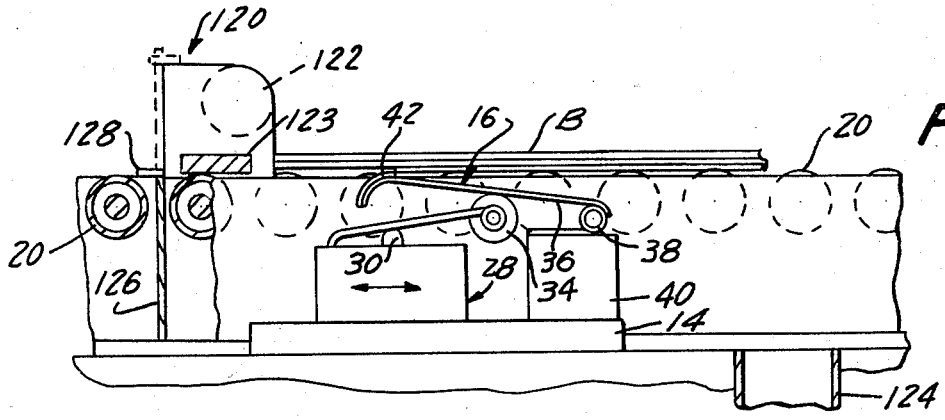
FIG. 9
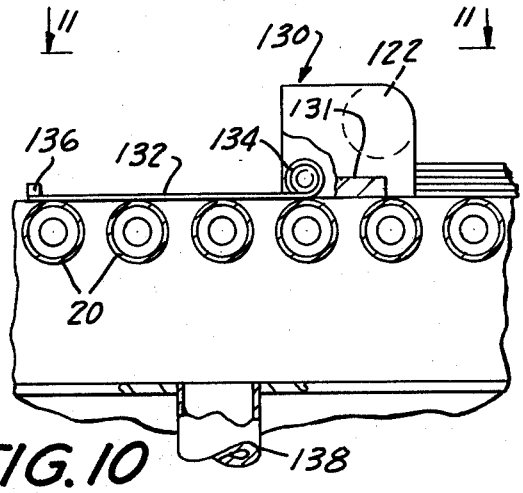
FIG. 10
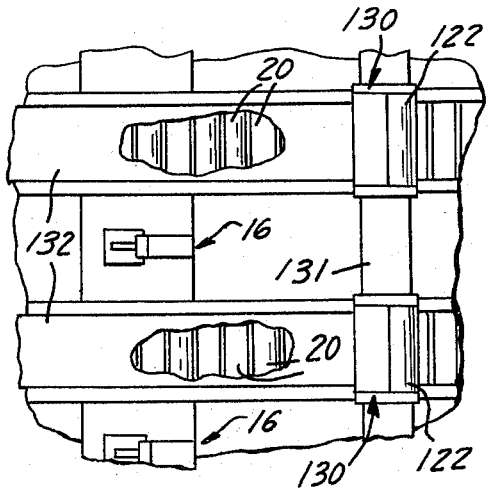
FIG. 11

ROLLING VACUUM FEED TABLE

BACKGROUND OF THE INVENTION

1. Field of the Invention

While the subject invention has utility in any sheet feeding system, it relates primarily to corrugated blank feeding equipment utilized in the corrugated paper industry wherein blanks are stacked and must subsequently be fed to processing equipment such as folding, cutting, creasing, and coating machines.

More particularly, the subject invention relates to feeding equipment wherein the lowermost blank is advanced from beneath the stack as contrasted to top sheet feeding which is utilized in some systems.

2. Prior Art

The prior art discloses many systems for feeding blanks which have featured various ways to apply suction to prevent the warped edges of advancing blanks from causing jam ups which result in machine down time. Standard feed beds of the type disclosed in U.S. Pat. No. 3,754,752 have utilized a perforated base plate to enable the suction to be applied to the lowermost blank to flatten warped or curled blanks during advancement.

In addition to the perforated plate type of structure, elongated rib-like vacuum chambers have also been used for the purposes of "flattening" or holding down warped blanks. Of detrimental consequence in both of these systems is the creation of friction between the blank and the table surface which must be overcome by the kicker device or other means used to advance the boards to the processing machinery. If the vacuum is too strong, inordinate friction is created between the advancing blank and the feed table surface requiring extreme force from the kicker device to push the sheets into the processing machinery where they are normally received by feed rolls. If the vacuum is relieved, then the front edge of the advancing blank may lift off the table causing jam ups, particularly if the blank is warped somewhat. In most standard processing machinery in the corrugated box industry, gates are positioned adjacent the feed rolls to prevent more than one blank from being fed to the processing machine simultaneously. It is against these gates that jam ups will occur when the vacuum is not sufficient to prevent the curling up of edges of warped board.

Additional types of suction assist devices have been utilized such as disclosed in U.S. Pat. No. 3,391,926 in which a top feeding system is disclosed. A suction chamber is utilized in combination with power driven wheels to enable the uppermost sheet to be driven by the wheels in the direction of the working machine where the sheet is fed onto a conveying belt or other means. The suction is not utilized to flatten warped board but rather, has the obvious purpose of enabling the uppermost board to be drawn into contact with the rotating wheels so that the board may be driven laterally by the wheels.

Powered wheels have also been used in combination with suction for alignment purposes as disclosed in U.S. Pat. No. 3,677,537. In this case, the wheels or friction rollers 20 are axially disposed in the direction of the advancing sheet. The purpose of the friction rollers 20 is to power drive the sheet that is to be advanced by feeder bar 32 to the desired alignment position against side guide structure 36.

Despite many different utilizations of suction assist techniques in the sheet feeding state of the art, the efficiency of all systems in use today leaves much to be desired. While generally, the most efficient way of advancing sheets has been the utilization of feed or kicker bar means, there has been lacking an effective way of supporting the advancing sheets whereby curling up of warped board and the like can be flattened while at the same time, the use of extreme suction, which serves to diminish the effectiveness of the feeding unit, can be avoided.

SUMMARY OF THE INVENTION

Accordingly, it is an object of the subject invention to provide in corrugated blank feeding equipment, an improved feed bed and improved means of applying vacuum to advancing blanks to enable maximum efficiency to be achieved.

It is a related object of the subject invention to provide an improved combination blank advancing means coupled with improved feed bed means whereby advancing blanks which may be warped may be held down or flattened to prevent jamming.

It is another object of the subject invention to provide improved means of channeling vacuum against the lowermost board to prevent warped boards from curling, leading to subsequent jamming.

It is an overall object of the subject invention to provide improved operating efficiency in feeding blanks while at the same time, preventing jamming which results in costly down time.

It is yet another object of the subject invention to provide a method and means of feeding blanks from the bottom where friction between the board to be advanced and the remainder of the stack of boards can be significantly reduced.

It is still another object of the subject invention to provide structural improvements whereby higher vacuum can be utilized to prevent warped boards from jamming without creating friction problems with respect to the power necessary to drive the boards forward to the processing machinery.

It is still another object of the subject invention to provide structural modifications whereby blanks may be fed at a substantially level plane to at least the close proximity of the processing machinery.

It is a related object of the subject invention to provide improved kicker bar structure whereby the kicker bar need not support the weight of the stack of boards causing the weight of the stack to be shifted forwardly thus creating friction problems for the advancing board.

It is yet another object of the subject invention to provide means of creating vibration to lessen the friction between the stack of blanks and the advancing blank.

It is a more specific object of the subject invention to provide a method of advancing blanks and structural improvements whereby a slight ripple is caused in the advancing sheet to create air pockets between the stack of blanks and the advancing blank to reduce friction.

In accordance with the above objects, an improved method of, and apparatus for, feeding sheets or blanks of material from stacks is disclosed herein. The invention is utilized with processing machinery which performs operations such as cutting, printing, embossing and the like, the machinery usually comprising a main frame with a feed platform at one end thereof which supports a stack of the blanks to be fed into the machine. There is included feeder bar means for advancing the lowermost blank from the stack to a pair of pull rolls which in turn advance each blank through the processing machine.

In the improved apparatus of this invention, a vacuum chamber is utilized in which there are disposed a plurality of rotatable rollers axially mounted in a direction perpendicular to the travel of the blanks of material. The mounting of the rollers is critical to provide suction paths which effectively hold down the sheet material during its travel which is facilitated by the rotating rollers. In one embodiment, the roller nearest the pull rolls and processing machinery is to be either larger than the other rollers or mounted with its center line at a higher vertical position to create a favorable pneumatic path in which warped blanks can effectively be controlled to prevent jamming. In another embodiment, the rollers are placed at varying heights to create a ripple-like effect in the advancing blank which helps to reduce friction between that blank and the remainder of the stack.

An air cushioned kicker feed bar such as disclosed in my U.S. Pat. No. 3,675,918 may be utilized to advance the single sheets to the feed rollers over the rolling vacuum feed base herein disclosed. However, it is preferable to mount the kicker feed bar with its pivotally mounted plate member and feed clip depressed in relation to the feed rollers. This may be effectively accomplished by utilizing alternating chambers of first a suction chamber with the feed rollers followed by an empty chamber in which a feeding member is positioned and so forth across the width of the machine. By such structure, the stack of blanks and the advancing blank may be maintained in a relatively horizontal position compared with prior designs where the kicker feed bar was mounted on top of the feed bed causing the stack and advancing sheet to tilt.

BRIEF DESCRIPTION OF THE DRAWINGS

FIG. 1 is a partial top view disclosing a rolling vacuum feed bed in which an air cushioned kicker feed bar is placed with its fingers in alternate strips across the width of the feed bed area;

FIG. 2 is a side sectional view taken along the lines 2—2 of FIG. 1;

FIG. 3 is a cross sectional side view showing the sheets being fed to the feed rolls on a feed bed which utilizes an enlarged end roller and a vacuum relief valve;

FIG. 3A is a cross sectional side view similar to FIG. 3, however, which utilizes a modified vacuum relief valve;

FIG. 4 is a cross sectional end view taken along the lines 4—4 of FIG. 3;

FIG. 5 is a cross sectional view of an end roller with center line above the axis of remaining rollers;

FIG. 8 is a schematic illustration of electrical circuitry which may be utilized for the feeding system;

FIG. 9 is a side view of the type feed table of FIG. 1 in which an adjustable back stop is shown;

FIG. 10 is a side view of a modified back stop; and

FIG. 11 is a partial plan view of the back stop and feed table of FIG. 10.

DETAILED DESCRIPTION

Figure 6:
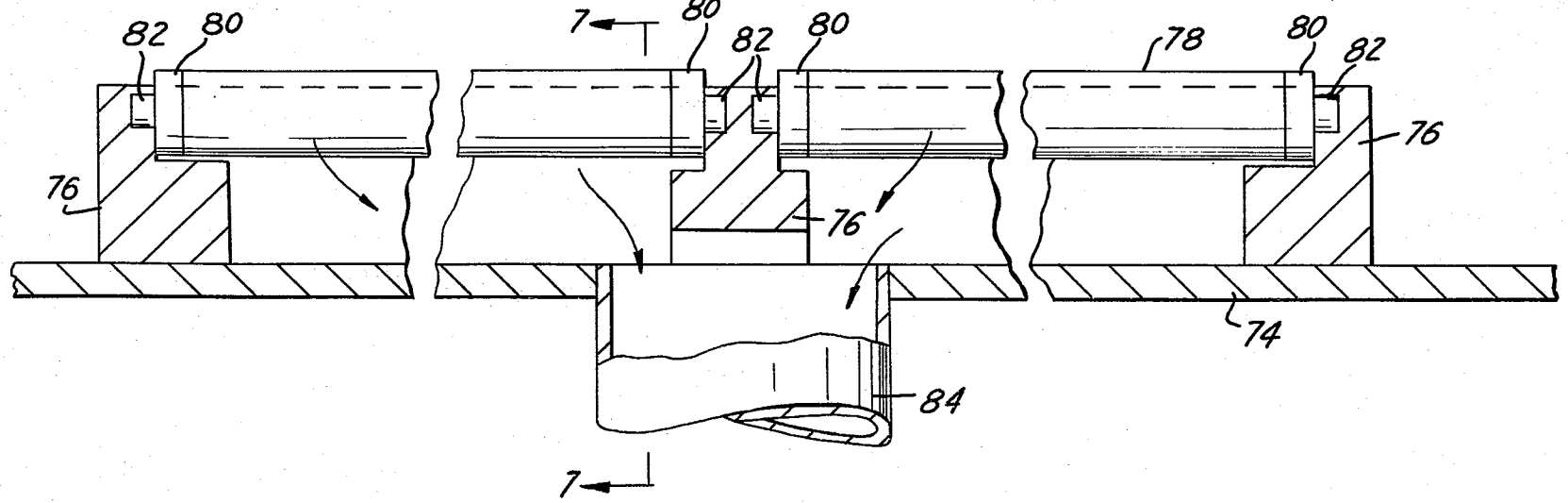
FIG. 6 is an end cross sectional view showing a means for mounting rollers in a feed table lay out where the alternate strips of FIG. 1 are not utilized.

In broad terms, the subject invention utilizes rotating rollers disposed within suction chambers to create a feed bed over which blanks may be advanced relatively free of friction, despite the application of heretofore unforeseeable amounts of vacuum against the advancing lowermost board.

With reference to FIG. 1, a preferred embodiment of the feed bed is shown. Positioned across the width of the machine are strip-like divisions to house alternating vacuum chamber strips 10 with feed advancing means disposed within the remaining strip chambers 12 hereinafter referred to as feed strips. The feed advancing means comprises a feed bar 14 which extends widthwise across the feed bed and below the alternating vacuum chambers 10. Air cushioned kicker members 16 are shown mounted on the feed bar 14 and protrude upwardly in each of the alternating feed strips 12 to engage the lowermost sheet of the stack.

The feed bar 14 reciprocates by means of linkage schematically shown by members 15 which are driven by drive shaft 17 to produce the reciprocating movement. Thus, feed bar 14 reciprocates in the same manner as feeder bar 30 of my U.S. Pat. No. 3,709,483.

Disposed between side walls 18 of the vacuum chambers 10 are rollers 20 which are mounted so as to be freely rotatable as will be described. A vacuum manifold 22 is shown as extending widthwise across the feed bed to provide suction capability via orifices 24 which lead into each of the vacuum chambers 10.

The feed bed may comprise any number of strips such as eight vacuum chambers 10 and the same number of feed strips 12. By control means (not shown) the vacuum supply to the outer vacuum chambers may be turned off to conserve energy when small size blanks are processed which do not reach the outer chambers when centered.

With reference to FIG. 2, a stack of blanks B are shown with the lowermost blank LB being advanced to the processing equipment as will be described. A back stop member 26 which need not be supported on the rollers 20 provides a guide for the stack of blanks B and may comprise a single bar or a plurality of individual members positioned along the width of the feed table. Side guides (not shown) may also be utilized to maintain the alignment of the stack in a desired position with respect to the processing equipment.

The air cushioned kicker feed assembly has been fully described in my U.S. Pat. No. 3,675,918 and utilizes a feed bar 14 upon which is mounted actuator mechanism 28 which may be identical to the actuator mechanism 59 disclosed in the aforementioned patent. A piston projection 30 which is the top portion of a piston (not shown) engages member 32 which is joined to rear roller 34 and overlies the piston projection 30. This rear roller 34 engages plate member 36 of the spring finger which is pivotally mounted as shown at 38 on mounting member 40 which in turn is rigidly secured to feeder bar 14. A feed clip 42 is mounted on the curved extremity of plate member 36 and is the engaging means for each of the feed fingers. While in principal, the air cushion feed assembly operates as disclosed in my aforementioned U.S. Pat. No. 3,675,918 (as well as U.S. Pat. No. 3,709,483) it should be noted that the mounting arrangement is different to improve the feed assembly's performance and permit its utilization in depressed areas along the width of the feed bed. Thus, the plate member 36 is pivotally mounted on the intermediate block member 40 and not directly on the feed bar 14.

As shown in FIG. 3, on most standard processing equipment, feed rolls 44 are utilized to draw the advanced sheet into the equipment where the creasing, cutting, folding etc. takes place. A front gate 46, which is also standard, is shown which serves to prevent any sheets other than the lowermost blank of material from being drawn into the feed rolls 44, since more than one blank would cause jamming. The bottom and side walls of the vacuum chamber are shown as 48 and 50, respectively. Extension 52 to vacuum manifold 22 is shown extending into chamber 12 to provide the vacuum source. It will be noted that in this embodiment, the roller 54 which is closest to the feed rolls 44 and the processing machinery is enlarged in comparison to the other rollers. While roller 54 is shown enlarged, it may be identical in size to rollers 20 only have its center line raised in the manner as roller 70 is shown in FIG. 5. Regardless of whether the end roller is enlarged as roller 54 or raised as roller 70, it serves to raise the level of the board as it approaches the feed rolls 44 and is advantageous in that it increases the suction effect against warped boards and results in improved performance.

Below roller 54, a leaf-like vacuum relief deflection member 56 is shown secured to the end wall 50 by attachment means 58. This leaf-like member 56 may be a strip of UHMW material .020 inch thick which terminates slightly beneath roller 54. When the suction is applied and the lowermost blank LB is advanced, the deflection member 56 serves as a valvable member so that when the blank LB passes over the top of the rollers cutting off the vacuum between the rollers, the increased vacuum will be applied to pull the leaf-like member 56 downwardly to enable pressure release.

With reference to FIG. 3A, the end wall 50 of the embodiment illustrated in FIG. 3 is replaced by a shortened end wall 51 and a vertical leaf-like flexible member 57 which may be constructed of spring steel and serves to prevent the escape of vacuum at the front edge of the vacuum chamber.

With reference to FIG. 4, the construction and mounting of roller 54 is shown but it is to be understood that this is the construction used as well for typical rollers designated 20. Thus, the rollers 54 may include a central shaft 60 which is mounted at each extremity in antifriction retainers 62 disposed along side walls 18 and positioned on base member 48 of the vacuum housing. Bearings 68 support the outer roller tube-like member 54 as shown with plate-like thrust bearings 72 being positioned between bearings 68 and the retainer member 62. This outer tube-like member 54 may be constructed of stainless steel, plastic or suitable material.

With reference to FIG. 5, a cross section of a roller is shown comprising the shaft 60 and outer roller member 70 with the center line of shaft 60 raised a distance of A over that of adjacent rollers 20. Thus, roller 70 may replace roller 54 as the last roller in the embodiment of FIG. 3.

Figure 5A:
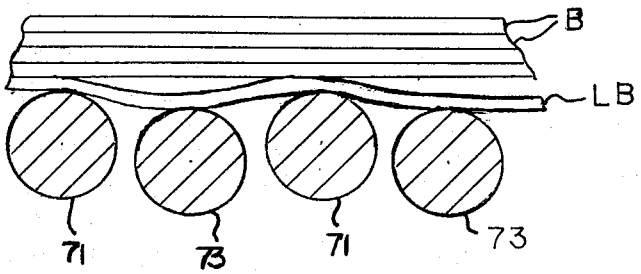
FIG. 5A is a cross sectional view of a series of rollers with center lines of alternating rollers offset in the manner of the roller of FIG. 5.

In place of the hollow rollers 30, 54, 70, solid rollers 71, 73 as shown in FIG. 5A may be utilized. Further, the alternating rollers 71 may be mounted with their center lines positioned above the center lines of rollers 73 so that the random rotating of the rollers will cause an eccentric path as the blank is advanced. In such a manner, a ripple will be created along the advancing blank LB producing air pockets between the advancing blank LB and the succeeding stack of blanks to minimize friction therebetween. While not to be deemed limiting, one inch rollers may be used with alternating center lines 0.05 inches apart.

Figure 7:
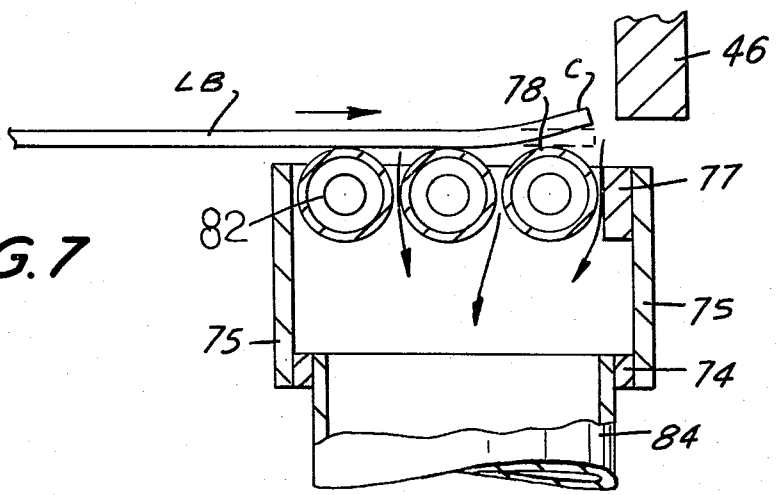
FIG. 7 is a cross sectional view taken along the lines 7—7 of FIG. 6.

With reference to FIGS. 6 and 7, an alternate embodiment is disclosed in which in place of the alternating strips of rollers, the rollers extend widthwise across the feed bed. As shown in FIG. 6, bottom vacuum chamber wall 74 supports anti-friction retaining members 76 which are positioned at intervals along the width of the machine. Hollow rollers 78 secured to solid end walls 80 may be utilized with pins 82 being rotatably mounted in the retaining members 76. Tube member 84 leads from the vacuum source to the vacuum chamber formed by members 74, 75, 76.

The positioning of the rollers 78 of FIG. 6 is shown in FIG. 7 and as few as three rollers may be utilized to provide support for the advancing blank LB. It can be visualized in FIG. 7 that a warped blank with a curled end C may be influenced by the suction as shown in phantom so that the end C is brought down or flattened to clear the front gate 46 as shown.

In the embodiment of FIGS. 6 and 7, the feed bar 14 with the kicker member 16 may either be depressed and to the left of the rollers 78 (see FIG. 7) or in the alternative positioned in a plane above the rollers 78 or directly above the rollers 78 assuming there are additional rollers to the series of three shown in FIG. 7.

A suitable type of circuitry such as shown in FIG. 8 may be utilized to provide a skip-feed operation as disclosed in my aforementioned U.S. Pat. No. 3,675,918. A suitable source of positive pressure 86 supplies each of the kicker actuator assembly mechanisms 28 through line 88 which passes through valve member 90. The valve may be controlled by a solenoid 92 from which control leads 94 and 96 extend to power line terminals 98 and 100 respectively when the feed control switch 102 is in its "regular feed" position as shown in FIG. 9.

The feed control switch 102 has two other positions, i.e., those shown in phantom with the switch at switch contact 104 for the off position and 106 for the "skip position". In the off position, since the connection between power line terminal 98 and the control lead 94 is opened, the solenoid 92 is deactuated and the valve 90 closed with the feed bar 14 remaining deactuated.

In the "skip position" the terminal 98 is connected to control lead 94 by way of control terminals 108 and 110 of flip-flop relay 112 of a commercially-available stable state type. The flip-flop relay 112 includes a pair of control terminals, 114 and 116 so that a control pulse supplied between these terminals is effective to change the flip-flop relay from either of its conduction states to the other and the next subsequent pulse is operated to flip the relay back to its first conduction state. These control terminals 114 and 116 are connected between power line terminals 98 and 100, with terminal 116 being connected directly to terminal 100 while control terminal 114 is connected to power line terminal 98 through the impulse switch censor 118 and the switch when it is set at contact 106 or in the skip position. When the machine is operating a control pulse is applied between the relay control terminals 114 and 116 each time the impulse switch censor 118 is closed. This switch censor 118 is closed when the feed bar 14 moves forward during its normal cycle of operation. When the feed control switch 102 is its skip position current will be supplied through flip-flop relay 112 to hold the valve 90 open during a given cycle of operation of the feed bar 14. The operation of the feed bar 14 will then close the impulse switch censor 118 thereby to apply a control pulse between control terminals 114 and 116 of relay 112 and change it to a non-conductive state. During the successive cycle of operation of the feed bar 14, no current will be supplied to valve 90 and accordingly, valve 90 will be closed so that the actuator mechanisms 28 will be deactuated. During the next stroke of feed bar 14 the impulse switch censor 118 will again be operated and will cause a voltage pulse to be applied between control terminals 114 and 116 of the relay 112 to return the flip-flop relay to a high-conduction state, thus opening solenoid valve 90 and reactuating the actuator mechanism 28 so as to feed the next subsequent sheet into the feed rolls 44.

With reference to FIG. 9, back stop members 120 having rotatable guide rollers 122 positioned across the width of each back stop member 120 are used to provide the rear support against which the blanks B are positioned. Thus, the blanks will normally be positioned in the hopper type arrangement between back stop 120 and the front gate structure 46 (see FIG. 3) and further secured between side-gates (not shown). A back stop member 120 may be provided above each of the vacuum chambers 10 which extend along widthwise across the machine as shown in the embodiment of FIG. 1. The back stop members 120 are joined by plate member 123 which extends widthwise across the machine and which may be provided with means to secure the plate members 123 and back stop members 120 firmly in place. In the particular arrangement disclosed in FIG. 9, the vacuum access means leading to the chamber below roller 20 is designated as 124 and is positioned forward of the probable positioning of the back stop 120.

It is to be noted that the back stop member 120 is adjustable and may be slid forward or to the rear along the roller members 20 as required to accommodate blanks of different sizes. The back stop member may also be provided with a vacuum close-off member 126 which as shown in FIG. 9, is lowered to within the chamber to restrict the vacuum to that portion of the chamber above which blanks are being transported. As shown, vacuum close-off member 126 may be a plate-like member extending widthwise across the chamber and having a handle 128 which also serves as a locking member when the close-off member 126 is positioned in its position of non-use, as shown in phantom in FIG. 9. The vacuum close-off member 126 may also be utilized as a stop or locking member to prevent movement of the back stop assembly during operation. Automation means may be utilized to control the vacuum close-off member 126.

With respect to FIG. 10, modified back stop members 130 are provided each having a blank positioning roller 122 as disclosed in the embodiment of FIG. 9. The back stop assembly which includes multiple back stop members 130 also includes widthwise member 131 which extends across the machine as shown in FIG. 11. In place of the vertical close-off member 126, an extendable roll-out curtain member 132 such as an industrial window shade is shown in FIGS. 10 and 11 as being extended from its storage roll 134. A handle type member 136 may be utilized or in the alternative, automation means may be provided to extend the roll-out curtain member 132 as desired. Thus, in the embodiment of FIGS. 10 and 11, the access 138 to the vacuum chamber from the vacuum manifold may be positioned at any place along the chamber 10 to provide the negative pressure without regard to the positioning of back stop member 130. The roll-out curtain member 132 serves to prevent the loss of pressure through the rollers 20 which are not in use when blanks of a small size are being processed at the time the back stop 130 is positioned in a forward position. The roll out curtain member may be constructed of light gage spring steel or from plastics such as reinforced nylon.

Thus, when large blanks are being processed, the back stop members 120, or 130, will be positioned as far to the left as is necessary to position the blanks B on the rollers. Corresponding adjustments will be made to feed bar 14 and the machine will be placed on a skip-feed setting. The air cushioned kicker feed bar assembly ensures a positive gripping action of each of the kicker members 16 during the feeding operation to minimize the possibility of malfunction. The vacuum chambers whether in alternating position such as chambers 10 of FIG. 1 or of the widthwise construction disclosed in FIG. 7 provide sufficient negative pressure to hold down at least the forward portion of the advancing blank LB to ensure that it is properly received by the feed rolls 44.

When small blanks are processed the back stop members 120, 130 are adjusted to the right as necessary.

In the embodiment generally shown in FIGS. 1 and 2, the depressed position of the kicker feed bar 14 and its kicker members 16 permits the stack of blanks to be retained in a horizontal flat position substantially as shown in FIG. 3. This is essentially true despite the use of an enlarged roller 54 or a raised roller 70 at the proximity of the front gates 46. In addition, the horizontal position as contrasted to an inclined position is maintained despite the use of rollers 71 and 73 as shown in FIG. 5A which are utilized to provide an eccentric path for the advancing blank LB. Thus, in this embodiment of FIGS. 1 and 2, the feed bar 14 is not positioned on the top of the feed bed as in conventional sheet feeding systems and which causes the sheet to be not fed in a flat plane but always dimensionally in a fore shortened plane and never in perfect register with subsequent machine cycle. However, in the embodiment of FIGS. 1 and 2, with the feed bar 14 depressed as shown in FIG. 2, only the air cushion kicker members 16 protrude in alternate strips and the blank may be fed in a flat plane to the feed rolls 44.

In the embodiments of FIGS. 3 and 5, by raising the roller surface beneath the gates 46 by either enlarged roller member 54 or the roller 70 whose center line is raised, the lead edge of the advancing blank seeks a definite reference point permitting the sheets to be fed free of jam-ups. This advance roller is preferably positioned at least partly under the front gate 46 and when the sheet has a small curl on its lead edge, it is extremely difficult to flatten even with high vacuum when the entire bed is in a flat plane.

The use of the rolling vacuum feed table described herein allows the utilization of much higher vacuum than used on most systems such as 100 inches of $H_2O$ to ensure that warped sheets are brought down to a flat plane eliminating the problem of previous systems whereby an increase of vacuum would create friction between the blanks and the table to the extent that the kicker device could not push the blank into the feed rolls 44. Thus, the rollers 20 which are shown as being freely rotatable, but which could conceivably be power driven in register with the feed bar 14 serve to eliminate the friction which was a cause of jam-ups previously.

It will be readily appreciated that the entire feed bed construction shown in FIGS. 1 and 2 may be utilized to replace the feed bed of an existing machine or in the alternative, the standard perforated plate feed bed commonly in use in industry today may be replaced by the chamber-like construction shown in FIGS. 6 and 7. In the latter situation, the kicker bar assembly of the existing machine may be utilized. While it is preferable to use the air cushioned feed bar kicker assembly, other kicker bar structures may also be advantageously used with the rolling vacuum feed table.

While various embodiments of the invention have been shown and described, it will be understood that other modifications may be made. The appended claims, therefore, are intended to define the true scope of the invention.

What is claimed is:

1. Apparatus for feeding blanks of sheet material to processing machinery comprising:

roller members axially positioned to rotate in the direction of travel of said blanks as said blanks are moved to said processing machinery, said roller members serving as a feed bed for supporting a stack of blanks and extending successively in the direction of travel of the blanks;

hold down means for said blanks including a vacuum source for providing negative pressure to be applied substantially throughout the space between said successive roller members against said lowermost blank of said stack; and means to move the lowermost blank of said stack toward said processing machinery.

2. The apparatus of claim 1 wherein said support means including said roller members are disposed in a series of strips; and said blank moving means are disposed in alternative strips between said roller members.

3. The apparatus of claim 1 wherein the blank moving means comprises a blank engaging portion and means for supporting said blank engaging portion and further where the means for supporting said blank engaging portion is depressed below the horizontal plane of said rollers.

4. The apparatus of claim 1 wherein said roller members are comprised of roller members of more than one size.

5. The apparatus of claim 1 wherein said roller members provide an eccentric path of travel for an advancing blank.

6. The apparatus of claim 1 wherein said roller members provide a flat plane of travel for an advancing blank.

7. The apparatus of claim 1 wherein said roller members are mounted about a central shaft.

8. The apparatus of claim 1 wherein said roller members are hollow and are rotatably secured by means of end structure.

9. The apparatus of claim 1 further including a front gate means and wherein the roller member closest to said processing machinery rotates in a higher plane than other of said roller members.

10. Apparatus for feeding blanks of sheet material to processing machinery comprising:

roller members axially positioned to rotate in the direction of travel of said blanks as said blanks are moved to said processing machinery, said roller members serving as a feed bed for supporting a stack of blanks;

hold down means for said blanks including a vacuum source for providing negative pressure to be applied between said roller members against said lowermost blank of said stack;

means to drive the lowermost blank of said stack to said processing machinery notwithstanding the application of negative pressure between said roller members against said lowermost blank; and an adjustable back stop member to be adjusted according to the size of blanks being processed, said back stop member including a means of preventing the application of vacuum between roller members over which blanks are not travelling during the feeding operation.

11. The apparatus of claim 10 further including a vacuum chamber beneath said roller members and wherein said means of preventing the application of vacuum through roller members over which blanks are not travelling during feeding operation comprises structure adjustable within said vacuum chamber.

12. The apparatus of claim 10 further including a vacuum chamber beneath said roller members and wherein said means for preventing the application of vacuum includes a member vertically disposed which is utilized to partition said chamber.

13. The apparatus of claim 10 wherein said means of preventing the application of vacuum includes a horizontally disposed member adjustable to cover roller members not in use.

14. Apparatus for feeding blanks of sheet material to processing machinery comprising:

support means for supporting a stack of blanks including roller means axially positioned perpendicular to the direction of travel that said blanks are moved for processing;

hold down means for said blanks including a vacuum source for providing negative pressure to be applied between said roller members against said lowermost blank of said stack;

means to drive the lowermost blank of said stack to said processing machinery despite the application of negative pressure between said roller members against said lowermost blank; and valvable structure responsive to vacuum pressure to prevent the escape of vacuum around certain of said roller means.

15. The apparatus of claim 14 wherein said valvable structure is horizontal where tangent to said certain of said roller members.

16. Apparatus for feeding blanks of sheet material to processing machinery comprising:

support means for supporting a stack of blanks including roller means axially positioned perpendicular to the direction of travel that said blanks are moved for processing;

hold down means for said blanks including a vacuum source for providing negative pressure to be applied between said roller members against said lowermost blank of said stack;

means to drive the lowermost blank of said stack to said processing machinery despite the application of negative pressure between said roller members against said lowermost blank; and a flexible deflection member juxtaposed to at least one end roller member to create a seal between said deflection member and said end roller member.

17. Apparatus for successively feeding the lowermost blank of a stack of sheet material to processing machinery comprising frame work for supporting said stack, said frame work including a series of vacuum chambers with rollers disposed across the top of said chambers; blank engaging means extendable to a plane above said rollers; and means for supporting said blank engaging means extending below said vacuum chambers whereby a stack of blanks supported on said rollers is successively engaged by said blank engaging means and fed to said processing machinery.

18. The apparatus of claim 17 wherein said blank engaging means comprises a feed bar assembly to successively feed said blanks to said processing machinery.

19. A method of singularly feeding blanks from a stack into processing machinery, comprising the steps of:

supporting said stack of blanks on supporting elements of feed bed structure;

engaging the bottom blank of said stack with an advancing means comprising at least one member along the side of said blank most remote from the processing machinery, said at least one member being reciprocable toward and away from said processing machinery along a path of travel which does not extend into a vertical plane above said supporting elements;

advancing the bottom blank into the processing machinery;

keeping the surface area of the advancing blank flat during advancement to the processing machinery during the time said advancing blank is engaged by said advancing means; and maintaining level guidance during advancement to the processing machinery by utilizing air pressure against said advancing blank.

20. The apparatus of claim 10 wherein said means of preventing the application of vacuum includes a horizontally disposed member adjustable to prevent the escape of negative pressure between roller members not in use during a feeding operation.

21. Apparatus for feeding blanks of sheet material to processing machinery comprising:

support means for supporting a stack of blanks including roller members positioned to rotate in the direction of travel of said blanks;

hold down means for said blanks including a vacuum source for providing negative pressure against said lowermost blank of said stack; and means for moving the lowermost blank of said stack to said processing machinery notwithstanding the application of negative pressure against said lowermost blank, said moving means including at least two engaging members for engaging said lowermost blank along the side most remote from said processing machinery and reciprocating means connected to said at least two engaging members and positioned to reciprocate beneath said support means.

22. The apparatus of claim 21 wherein said engaging members comprise kicker members and said reciprocating means comprises a kicker feed bar.

23. Apparatus for feeding blanks of sheet material to processing machinery comprising:

a feed bed for supporting a stack of blanks including roller members axially positioned perpendicular to the direction of travel that said blanks are moved for processing, said roller members being disposed in strips across said feed bed with each strip being comprised of a plurality of roller members and with each plurality of roller members extending successively in the direction of travel of the blanks;

hold down means for said blanks including a vacuum source for providing negative pressure to be applied substantially throughout the space between said successive roller members against said lowermost blank of stack; and means to move the lowermost blank of said stack to said processing machinery.

* * * * *